US006845515B2

(12) United States Patent
Sveilich

(10) Patent No.: US 6,845,515 B2
(45) Date of Patent: Jan. 25, 2005

(54) SHIN REST

(76) Inventor: Ian J. Sveilich, 8 Avenue G, Old Lyme, CT (US) 06371

( * ) Notice: Subject to any disclaimer, the term of this patent is extended or adjusted under 35 U.S.C. 154(b) by 0 days.

(21) Appl. No.: 10/730,769

(22) Filed: Dec. 8, 2003

(65) Prior Publication Data

US 2004/0244089 A1 Dec. 9, 2004

Related U.S. Application Data

(63) Continuation of application No. 10/188,900, filed on Jul. 3, 2002, now abandoned.

(51) Int. Cl.[7] ..... A41D 13/00
(52) U.S. Cl. ..... 2/22
(58) Field of Search ..... 2/22, 24, 16, 455, 2/911; 602/23, 62

(56) References Cited

U.S. PATENT DOCUMENTS 5,083,391 A * 1/1992 Kyler ..... 406/42
5,301,370 A * 4/1994 Henson ..... 2/22
6,158,051 A * 12/2000 Belzidsky ..... 2/22
6,256,787 B1 * 7/2001 Tyler ..... 2/22
6,415,441 B1 * 7/2002 Nelson ..... 2/22
6,438,754 B1 * 8/2002 Canney ..... 2/22

* cited by examiner

*Primary Examiner*—Tejash Patel
(74) *Attorney, Agent, or Firm*—Cantor Colburn LLP; Victor E. Libert

(57) ABSTRACT

A shin rest (10) worn by someone who is kneeling enables the wearer's shin to bear at least some of his or her weight to thereby reduce the stress imposed on the wearer's feet. The shin rest (10) also allows the user to sit back on his or her heels without bringing undue weight to bear on the ankle or the ball of the foot. The shin rest (10) has a body portion (12) that contacts the surface S on which the wearer is kneeling, and thereby supports at least some of the weight and resultant stress otherwise imposed upon the wearer's feet while the wearer is in a kneeling position. The body portion (12) is held to the user's leg by a plurality of straps (14, 16, 18). In a preferred embodiment, the body portion (12) of the shin rest (10) comprises a relatively hard outer shell (26) and a relatively soft cushion liner (24).

16 Claims, 4 Drawing Sheets

SHIN REST

This application is a continuation of 10/188,900, filed Jul. 3, 2002, now abandoned.

BACKGROUND OF THE INVENTION

1. Field of the Invention

This invention pertains to devices, referred to herein as "shin rests", that are attachable to a wearer's leg to prevent strain and/or discomfort, especially to the feet and ankles, while the wearer is in a kneeling position.

2. Related Art

Various kinds of activities require a person to assume a kneeling position for extended periods of tine, for example, gardening, landscaping, tiling, installation of flooring or carpeting, and roofing. Most people find that kneeling for a protracted period can generate intense discomfort in their lower extremities. A partial solution for the alleviation of such discomfort is the known use of knee pads, which provide a cushion that is worn over the knees to cushion the knees from bearing directly against a hard surface or object.

SUMMARY OF THE INVENTION

Generally, the present invention provides a shin rest that is worn to support at least the wearer's shins and ankles while the wearer is in a kneeling position. The shin rest of the invention prevents or at least greatly reduces stress on the ankles and feet that, but for the shin rest of the invention, is ordinarily experienced in the unsupported toes-in or toes-out kneeling postures described below. The shin rest is preferably contoured and cushioned to comfortably engage the wearer's shin and the top of the wearer's foot or footwear. Fasteners such as straps are attached to the shin rest to hold it in place on the wearer's leg. In use, a shin rest of the present invention would, of course, be worn on each leg.

Specifically, in accordance with the present invention there is provided a shin rest having a body portion which is dimensioned and configured to have a length which extends from about the top of a wearer's foot at least to a point below the wearer's knee, a width which is at least sufficient to provide stable support for the wearer's leg when the wearer is in a kneeling position, and a depth, at least in the vicinity of the top of the wearer's foot, which is sufficient to provide support to the wearer's leg whereby to reduce the force imposed on the wearer's foot when the wearer is in a kneeling position, as compared to the force which, in the absence of the shin rest, would be imposed on the same wearer's foot in the same kneeling position. The body portion has connected to it one or more fasteners, e.g., straps. The fasteners are dimensioned and configured to secure the shin rest to the wearer's leg.

Another aspect of the present invention provides a shin rest comprising the following components. A body portion comprised of (a) an outer shell having an outside surface and an inside surface, and (b) a cushion liner disposed on the inside surface of the shell is dimensioned and configured as follows. The body portion extends from about the top of a wearer's foot to at least a point on the wearer's shin below the knee, is of a width at least sufficient to provide stable support for the wearer's leg when the wearer is in a kneeling position, and is of a depth at least sufficient to reduce the force imposed on the wearer's foot when the wearer is in a kneeling position, as compared to the force which, in the absence of the shin rest, would be imposed on the same wearer's foot in the same kneeling position. One or more fasteners are connected to the body portion and are dimensioned and configured to secure the shin rest to the wearer's leg.

In particular aspects of the present invention, the body portion may have one or more of the following dimensions: a length of from about 12 to about 26 centimeters; a depth of about 5 to about 13 centimeters; and a width of from about 7 to about 13 centimeters.

Another aspect of the present invention provides that the body portion further comprises (a) an outer shell having an outside surface and an inside surface, and (b) a cushion liner, e.g., made of an elastomeric foam, lining the inside surface, which liner is dimensioned and configured to bear against the wearer's shin when the shin rest is secured to the wearer's leg.

Other aspects of the present invention comprise one or more of the following features, alone or in any suitable combination of two or more such features. The cushion liner may be dimensioned and configured to bear against the wearer's shin when the shin rest in secured to the wearer's leg; the outer shell may be comprised of a rigid material; the outer shell may have one or more bumper strips disposed on its outside surface; the cushion liner may be substantially coextensive with the outer shell; the fasteners may comprise straps and connectors to secure the straps to the wearer's leg; one or more of the straps may be dimensioned and configured to wrap around the wearer's lower leg, and one or more of the straps may be dimensioned and configured to wrap around the wearer's foot; the body portion, at least along the length thereof which extends from about the top of the wearer's foot to a point below the wearer's knee, may have a depth from about 5 to about 13 centimeters; the body portion may extend from about the top of the wearer's foot to and including the wearer's knee, so that the body portion comprises a shin pad and a knee pad; and the knee pad and the shin pad are connected by an articulated joint to enable the knee pad to flex as the wearer bends and straightens his or her knee.

DETAILED DESCRIPTION OF THE INVENTION AND PREFERRED EMBODIMENTS THEREOF

Before describing embodiments of the present invention, a brief description of the problems it overcomes is useful.

Figure 1:
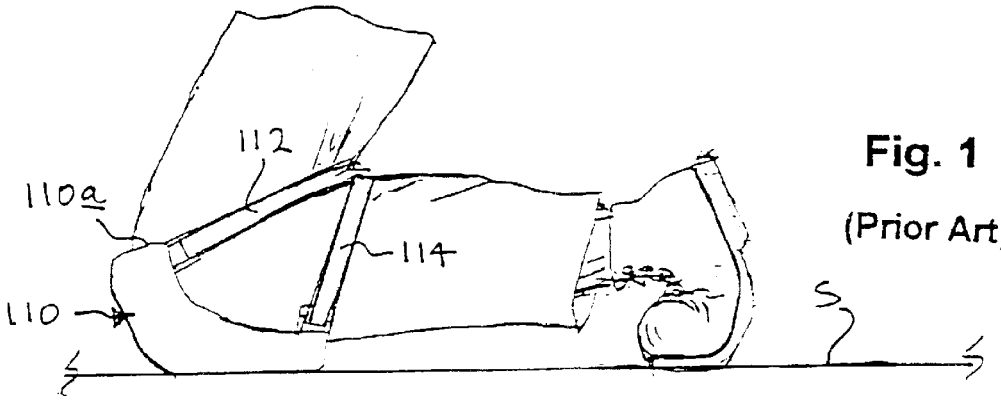
Fig. 1 (Prior Art)
FIG. 1 and FIG. 2 are elevation partial views of the leg of a kneeling person in, respectively, a toes-in and toes-out posture, showing the use of a knee pad in accordance with the prior art.
Figure 2:
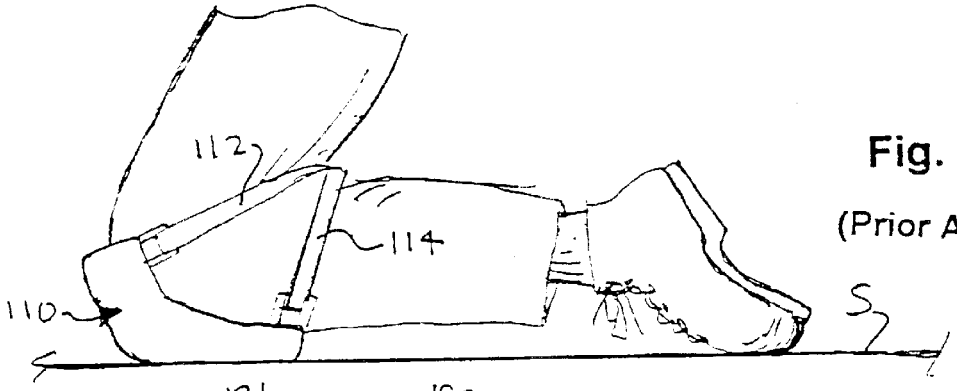
Fig. 2 (Prior Art)

Two types of kneeling postures showing the use of knee pads in accordance with the prior art are illustrated in FIGS. 1 and 2. FIG. 1 shows a known knee pad 110 comprising an interior cushion 110*a* and straps 112 and 114 worn by a person kneeling on a surface S. Cushion 110*a* is typically made from an elastomeric foam encased in fabric and it is often contoured to fit the curvature of the knee when bent. Adjustable straps 112 and 114 extend around the leg from one side of cushion 110*a* to the other to keep the knee pad on the wearer's leg. FIG. 1 shows a kneeling posture referred to herein as "toes-in" to indicate that the wearer's toes and, optionally, the wearer's ankle, are flexed so that the toes point generally towards the knee. FIG. 2 shows an alternative kneeling posture referred to herein as "toes-out", in which the wearer of knee pad 110, kneeling on the surface S, has his or her ankle and toes extended so that the toes point away from the knee. Despite the use of the knee pad 110, both the toes-in and toes-out postures tend to result in discomfort that is not ameliorated by the knee pad, because the foot, ankle and all or most of the shin are unsupported. In both the toes-in and toes-out kneeling postures, the feet are stressed, as they are bearing weight while in a curved position. Remaining in either kneeling posture for a protracted period of time causes discomfort and may cause or aggravate foot problems. In the toes-in posture of FIG. 1, if the person kneels back to sit on his or her heels, some of the person's weight is borne on the toes, ankles and on the balls of the user's feet, quickly resulting in discomfort. In the toes-out posture of FIG. 2, sitting back on the heels presses the ankle joint toward hyperextension and thus causes discomfort. Furthermore, footwear is generally not designed to sustain either a toes-in or toes-out posture, and the person's footwear can pinch or otherwise cause additional discomfort to the foot and ankle in these kneeling postures.

Figure 3:
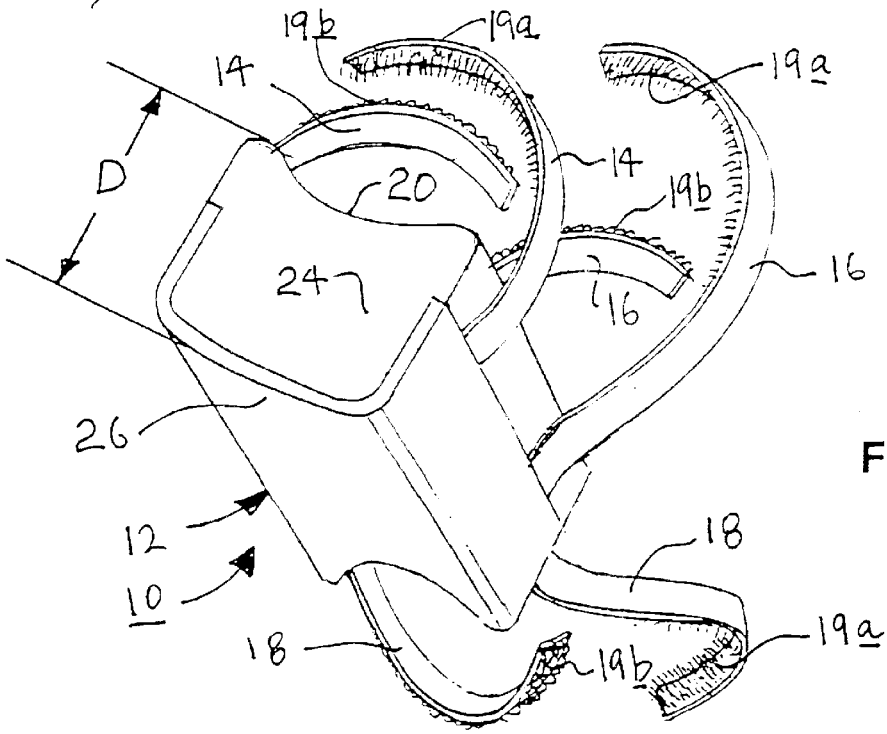
FIGS. 3 and 3A are perspective views of a shin rest in accordance with a particular embodiment of the present invention.
Figure 3A:
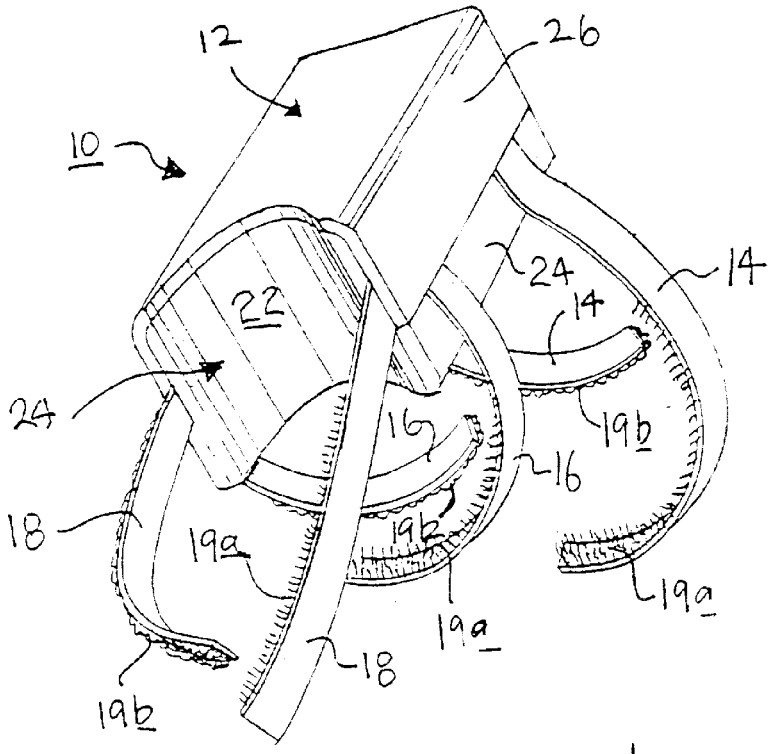

Shin rest 10 shown in FIGS. 3, 3A, 3B and 3C is representative of one particular embodiment of the present invention. Shin rest 10 comprises a body portion 12 to which a plurality of adjustable straps 14, 16 and 18 are attached. Body portion 12 is configured to have a back surface 20 which may be contoured to generally conform to a wearer's shin, i.e., back surface 20 may be made concave. In the illustrated embodiment however, a thick cushion liner 24, described below, is secured to back surface 20. Bottom surface 22 is also preferably concave or otherwise configured to engage or conform to the top of the wearer's foot or footwear. Fasteners, provided by leg straps 14 and 16 in this embodiment, are configured to reach around the user's leg to hold shin rest 10 on the user's leg. Other fasteners, provided by foot straps 18 in this embodiment, are configured so that they may extend around the bottom of the wearer's foot or footwear. The fasteners can be secured by any suitable connectors, to secure shin rest 10 in place with the bottom surface 22 thereof positioned against or closely adjacent to the top of the wearer's foot. FIGS. 3 and 3A show fabric-and-loop-type fasteners 19*a*, 19*b* of the type sold under the trademark Velcro®.

Body portion 12 of shin rest 10 preferably comprises a soft cushion liner 24 and a hard outer shell 26. Shell 26 is formed from a material that is strong enough to protect cushion 24 and the wearer's shin from hazardous objects such as sharp-edged stones, glass fragments, nails, etc., that may be on the surface on which the user is kneeling. Shell 26 may be made of any suitable material, such as a rigid plastic (synthetic organic polymeric material). By "rigid" is meant a material which does not bend or deform to a significant extent under the wearer's weight when the wearer is in a kneeling position on the shin rest. A material having a flexural modulus similar or identical to the outer shell of a baseball catcher's shin guards would be an appropriate choice of material for the outer shell 26 of the shin rest 10 of the present invention. Cushion liner 24 is shaped to conform at least somewhat to that portion of a wearer's shin which bears against it. The surface of cushion liner 24 which is contacted by the wearer's shin may thus be concave. Cushion liner 24 may be made from any of a variety of elastomeric foams of the kind useful in conventional knee pads, or any other suitable material, and the elastomeric foam may be encased in a suitable fabric casing, not shown.

Figure 4:
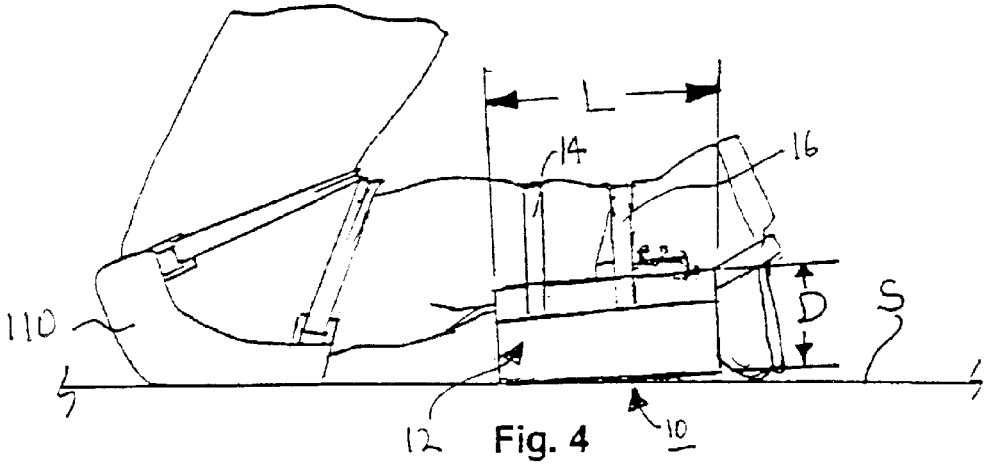
FIG. 4 is an elevation partial view of the leg of a kneeling person wearing a shin rest in accordance with the present invention while in a modified toes-in posture.
Figure 4A:
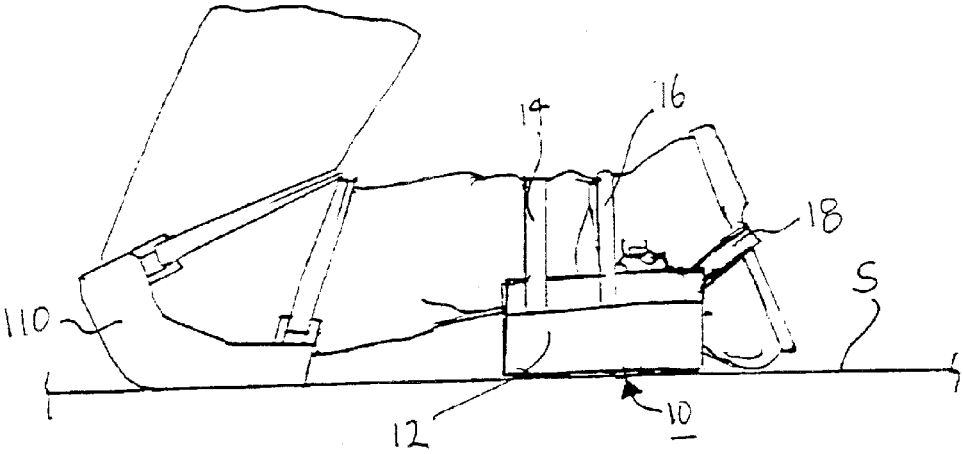
FIG. 4A is an elevation view of the leg of a kneeling person wearing a shin rest in accordance with the present invention while in a modified toes-out posture.

FIGS. 4 and 4A illustrate the use of shin rest 10 by a wearer kneeling on the surface S. Shin rest 10 is preferably worn low on the shin so that the bottom surface bears against or is closely adjacent to the top of the wearer's foot or footwear. Fasteners comprised of the straps 18 are wrapped about the wearer's foot and fasteners comprised of the straps 14 and 16 are wrapped about the wearer's leg and ankle. The straps cooperate to keep shin rest 10 in place on the wearer's leg. As illustrated in FIGS. 4 and 4A, strap 18 advantageously passes adjacent to the front of the heel of the wearer's boot or shoe. In one particular embodiment, any or all of the straps may comprise hook-and-loop-type fasteners 19*a*, 19*b*, such as the well-known Velcro® fasteners, although a variety of other types of straps and fasteners are well-known in the art as equivalent thereto and may be used in place thereof. In another embodiment, straps 14 and 16 may be replaced by a single strap. In the kneeling postures of FIGS. 4 and 4A, even if the user sits back on his or her heels, his or her foot need not be fully extended or bent, and the user's ankle and foot will not have to bear the full weight of his or her torso in the fully-extended position. Instead, a significant portion of the weight will be borne on the front of the shin by the support provided by the body portion 12 of shin rest 10.

In order to attain this purpose, shin rest 10 has a suitable depth D (FIGS. 3 and 4), which may be, e.g., from about 5 to about 13 centimeters (roughly, about 2 to 5 inches). Depth D should be great enough to take up at least some of the weight which would otherwise be borne by the wearer's feet in the kneeling position of FIG. 4 (nominally, toes-in) or FIG. 4A (nominally, toes-out). In both cases, the wearer's foot is bent only slightly, if at all, as compared to the prior art illustrated in FIGS. 1 and 2. Accordingly, the distinction between toes-in and toes-out largely if not entirely disappears by use of the shin rest of the present invention. In both cases, shin rest 10 allows the user to sit back on his or her beets without causing undue stress or discomfort on the ankle, toes or feet.

The length L (FIG. 4) may be any suitable length, e.g., from about 12 to about 26 centimeters (roughly, about 5 to 10 inches). The width W (FIG. 1C) of shin rest 10 should be wide enough to provide stable support for the wearer's leg, or at least the lower leg, when the wearer is in a kneeling position.

Width W may be, e.g., from about 7 to about 13 centimeters (roughly, about 2 and ¾ to about 5 and ⅛ inches). The shin rest may come in several sizes and the length L and the depth D, as well as the width W, may vary. The dimensions L and D, which may lie within or without the above ranges, are selected so that the beneficial effect of reducing stress on the wearer's feet, ankles and toes is attained as described above.

It is seen that, in the kneeling postures of both FIGS. 4 and 4A, the ankle, foot and toes are in less extreme flexure or extension relative to the kneeling postures of FIGS. 1 and 2, and discomfort caused by the stresses imposed on the foot as shown in FIGS. 1 and 2 is reduced by use of shin rest 10.

Figure 3B:
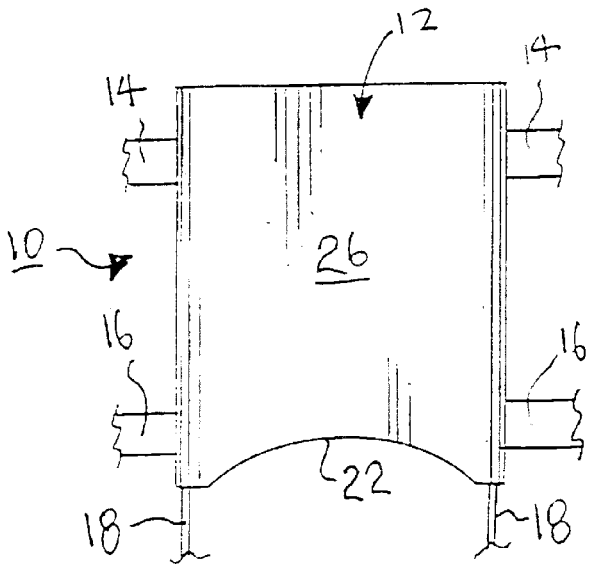
FIG. 3B is a front elevation view of the shin rest of FIGS. 3 and 3A, showing the outside surface of the outer shell.
Figure 3C:
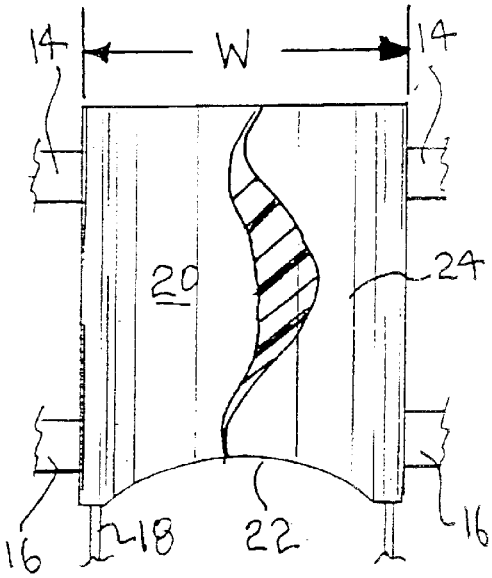
FIG. 3C is a rear elevation view of the shin rest of FIGS. 3 and 3A, showing the cushion liner partly broken away.
Figure 5:
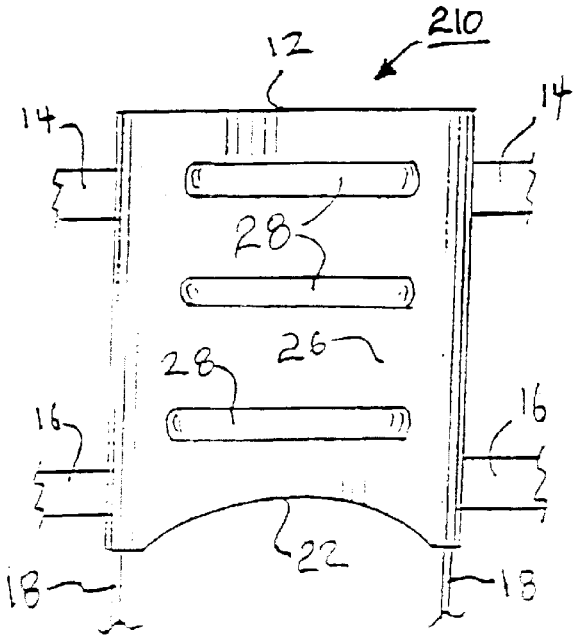
FIG. 5 is a view corresponding to FIG. 3B of a second embodiment of a shin rest in accordance with the present invention.

FIG. 5 shows a second embodiment of the present invention comprising a shin rest 210, parts of which are identical to those of the embodiment of FIG. 3B, and are numbered identically to those of FIG. 3B. These identical parts therefore need not be further described. Shin rest 210 differs from shin rest 10 of FIGS. 3–3C in that there is disposed on the outside surface (unnumbered) of outer shell 26 a plurality of bumper strips 28 which comprise raised strips of a soft, resilient material such as rubber, or a resilient, soft plastic material. Bumper strips 28 serve to prevent the rigid shell 26 from marring the surface on which the wearer is kneeling, e.g., a finished wood floor.

Figure 6:
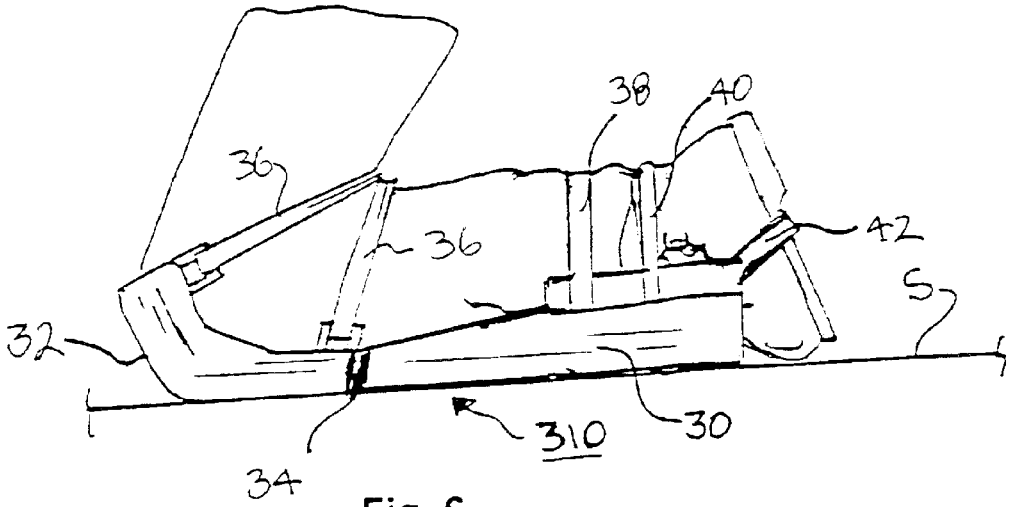
FIG. 6 is a view corresponding to FIG. 4A of a kneeling person wearing a shin rest in accordance with a third embodiment of the present invention, while in a modified toes-out posture.

FIG. 6 shows a third embodiment of the present invention wherein the shin rest 310 extends from about the top of the wearer's foot to above the wearer's knee and is comprised of a shin pad 30 and a knee pad 32. An articulatable joint 34 connects shin pad 30 to knee pad 32, thereby enabling shin pad 32 to flex to accommodate the wearer's movement, i.e., rising from and returning to a kneeling position. The lower portion, i.e., the portion closest to the wearer's foot, of shin pad 30 is constructed to be substantially the same as that illustrated with respect to the embodiment of FIGS. 3–3C. Bumper strips such as bumper strips 28 of the embodiment of FIG. 5 may extend along the entire length of shin pad 30, and for at least that portion of knee pad 32 which comes into contact with the surface S on which the wearer is kneeling. (Bumper strips 28 are not shown in FIG. 6.) As with the other embodiments, fasteners in the form of straps 36, 38, 40 and 42 are provided to enable the wearer to strap shin rest 310 to his or her leg as shown. The overall length of shin rest 310 will usually be from about 35 to about 55 centimeters (roughly, 13¼ to 22 inches).

Obviously, the user will normally wear a shin rest in accordance with the present invention on each leg. Further, the straps, such as straps 36, 38, 40 and 42 of the embodiment of FIG. 6, are provided with suitable connectors to enable adjustment of the straps to fit the wearer's leg and/or foot, and to secure the adjusted strap in place. Fabric fasteners of the type sold under the trademark Velcro® are well suited for the purpose. Naturally, any other suitable types of fasteners may be employed, such as buckles, snaps or the like.

While the invention has been described in detail with reference to particular embodiments thereof, it will be understood by one of ordinary skill in the art upon a reading and understanding of the foregoing disclosure that numerous alterations and equivalent substitutions to what is shown and described herein may be made without departing from the spirit or scope of the invention.

What is claimed is:

1. A shin rest comprising:

a body portion which is dimensioned and configured to have a length which extends from about the top of a wearer's foot at least to a point below the wearer's knee, and a width which is at least sufficient to provide stable support for the wearer's leg when the wearer is in a kneeling position, and a depth, at least in the vicinity of the top of the wearer's foot, which is sufficient to provide support to the wearer's leg wherein the force imposed on the wearer's foot is reduced when the wearer is in a kneeling position, as compared to the force which, in the absence of the shin rest, would be imposed on the same wearer's foot in the same kneeling position;

one or more fasteners connected to the body portion and dimensioned and configured to secure the shin rest to the wearer's leg.

2. A shin rest comprising:

a body portion comprised of (a) an outer shell having an outside surface and an inside surface, and (b) a cushion liner disposed on the inside surface of the shell, the body portion being dimensioned and configured (i) to be a length which extends from about the top of a wearer's foot to at least a point on the wearer's shin below the knee, (ii) to be of a width at least sufficient to provide stable support for the wearer's leg when the wearer is in a kneeling position, and (iii) to be of a depth at least sufficient to provide sufficient support to he wearers' leg wherein the force imposed on the wearer's foot is reduced when the wearer is in a kneeling position, as compared to the force which, in the absence of the shin rest, would be imposed on the same wearer's foot in the same kneeling position; and one or more fasteners connected to the body portion and dimensioned and configured to secure the shin rest to the wearer's leg.

3. The shin rest of claim 1 or claim 2 wherein the length the body portion is from about 12 to about 26 centimeters.

4. The shin rest of claim 1 or claim 2 wherein the depth the body portion is from about 5 to about 13 centimeters.

5. The shin rest of claim 1 or claim 2 wherein the width the body portion is from from about 7 to about 13 centimeters.

6. The shin rest of claim 1 wherein the body portion comprises (a) an outer shell having an outside surface and an inside surface, and (b) a cushion liner lining the inside surface, which liner is dimensioned and configured to bear against the wearer's shin when the shin rest is secured to the wearer's leg.

7. The shin rest of claim 6 wherein the cushion liner is comprised of an elastomeric foam.

8. The shin rest of claim 2 wherein the cushion liner is dimensioned and configured to bear against the wearer's shin when the shin rest in secured to the wearer's leg.

9. The shin rest of claim 2 or claim 6 wherein the outer shell is comprised of a rigid material.

10. The shin rest of claim 9 wherein the outer shell has one or more bumper strips disposed on its outside surface.

11. The shin rest of claim 2 or claim 6 wherein the cushion liner is substantially coextensive with the outer shell.

12. The shin rest of claim 1 or claim 2 wherein the fasteners comprise straps and connectors to secure the straps to the wearer's leg.

13. The shin rest of claim 12 wherein one or more of the straps are dimensioned and configured to wrap around the wearer's leg, and one or more of the straps are dimensioned and configured to wrap around the wearer's foot.

14. The shin rest of claim 1 or claim 2 wherein the depth of the body portion, at least along the length thereof which extends from about the top of the wearer's foot to a point below the wearer's knee, is from about 5 to about 13 centimeters.

15. The shin rest of claim 1 or claim 2 wherein the body portion extends from about the top of the wearer's foot to and including the wearer's knee, and comprises a shin pad connected to a knee pad.

16. The shin rest of claim 15 wherein the knee pad and the shin pad are connected by an articulated joint to enable the knee pad to flex as the wearer bends and straightens his or her knee.

* * * * *